US011446799B2

(12) United States Patent
Huang

(10) Patent No.: US 11,446,799 B2
(45) Date of Patent: Sep. 20, 2022

(54) TORQUE WRENCH

(71) Applicant: Hung-Wen Huang, Taichung (TW)

(72) Inventor: Hung-Wen Huang, Taichung (TW)

( * ) Notice: Subject to any disclaimer, the term of this patent is extended or adjusted under 35 U.S.C. 154(b) by 0 days.

(21) Appl. No.: 17/235,483

(22) Filed: Apr. 20, 2021

(65) Prior Publication Data

US 2021/0379742 A1 Dec. 9, 2021

(30) Foreign Application Priority Data

Jun. 9, 2020 (TW) ..... 109119335

(51) Int. Cl.
*B25B 23/142* (2006.01)

(52) U.S. Cl.
CPC ..... *B25B 23/1427* (2013.01)

(58) Field of Classification Search
CPC ..... B25B 23/1427
USPC ..... 81/475, 478, 483
See application file for complete search history.

(56) References Cited

U.S. PATENT DOCUMENTS 4,901,610 A * 2/1990 Larson ..... B25B 23/1427 81/473
5,503,042 A * 4/1996 Larson ..... B25B 23/1427 81/478
6,948,410 B1 * 9/2005 Larson ..... B25B 23/1427 81/479
8,141,463 B2 * 3/2012 Lai ..... B25B 23/1427 81/475

* cited by examiner

*Primary Examiner* — Anne M Kozak
*Assistant Examiner* — Bobby Lee Budziszek
(74) *Attorney, Agent, or Firm* — Muncy, Geissler, Olds & Lowe, P.C.

(57) ABSTRACT

A torque wrench is provided, including a main body, a driving portion, a positioning member, a torque adjusting assembly and a tripping assembly. The main body defines an axial direction. The driving portion is disposed on an end of the main body. The positioning member is fixedly disposed in the main body. The torque adjusting assembly includes an abutting member and a mandrel, and the mandrel is disposed in the main body, rotatable about the axial direction and screwed to the abutting member. The tripping assembly includes an elastic abutting member and a plurality of notches arranged circumferentially one of the elastic abutting member and the plurality of notches is disposed on the mandrel, and the other of the elastic abutting member and the plurality of notches is disposed on the positioning member.

9 Claims, 8 Drawing Sheets

TORQUE WRENCH

BACKGROUND OF THE INVENTION

Field of the Invention

The present invention relates to a torque wrench.

Description of the Prior Art

Generally, a torque value of a common torque wrench can usually be set to assemble or disassemble different types of components. One of two ends of a main body of the torque wrench has a driving head, the other of the two ends of the main body has a central pushing rod to adjust a torque setting value, a rotating member which is adjustable is assembled on the other of the two ends of the main body, when the rotating member is rotated, the central pushing rod is driven by the rotating member to move axially so as to adjust the torque setting value of the torque wrench. However, the rotating member is used to drive the central pushing rod to move, and since the central pushing rod is flexible, the rotating member requires a little effort to rotate, so it is hard to control a rotating speed of the rotating member, and it is hard to predict a rotating range of the rotating member. Therefore, the user cannot adjust the torque value to the value which s/he wants easily.

The present invention has arisen to mitigate and/or obviate the afore-described disadvantages.

SUMMARY OF THE INVENTION

The major object of the present invention is to provide a torque wrench which provides vibration and sound effects when a rotating member is rotated, the vibration and sound effects can remind a user of a rotating range of the rotating member to prevent over-rotating.

To achieve the above and other objects, a torque wrench is provided, including a main body, a driving portion, a positioning member, a torque adjusting assembly and a tripping assembly. The main body defines an axial direction. The driving portion is disposed on an end of the main body, and when the driving portion receives a torque which is greater than a torque setting value, the driving portion is idling. The positioning member is fixedly disposed in the main body. The torque adjusting assembly includes an abutting member and a mandrel, the abutting member is movable along the axial direction to adjust the torque setting value, the mandrel is disposed in the main body, rotatable about the axial direction and screwed to the abutting member, and the mandrel is disposed through the positioning member and rotatable about the axial direction. The tripping assembly includes an elastic abutting member and a plurality of notches arranged circumferentially, one of the elastic abutting member and the plurality of notches is disposed on the mandrel, the other of the elastic abutting member and the plurality of notches is disposed on the positioning member, the elastic abutting member is abutted against one of the plurality of notches normally, and when the mandrel rotates relative to the positioning member, the elastic abutting member trips among the plurality of notches.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
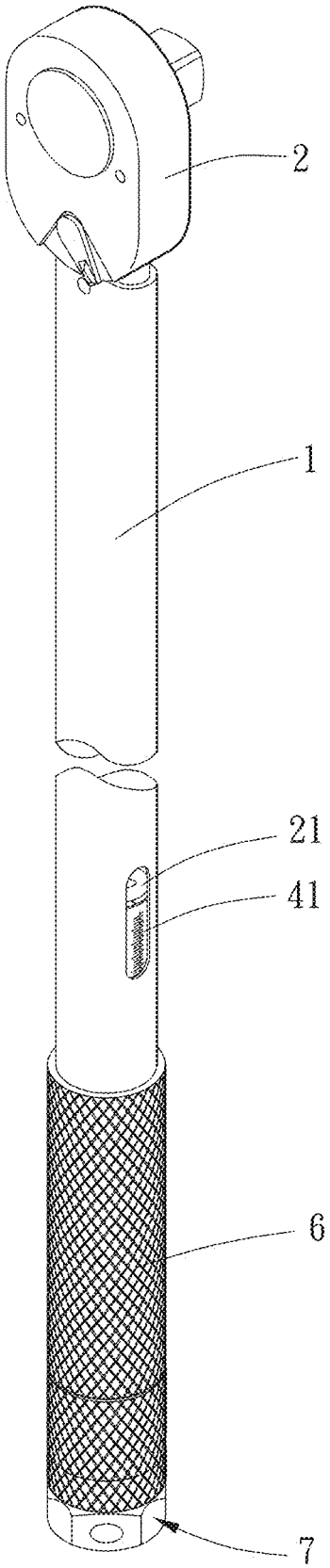
FIG. 1 is a stereogram of a preferred embodiment of the present invention.
Figure 2:
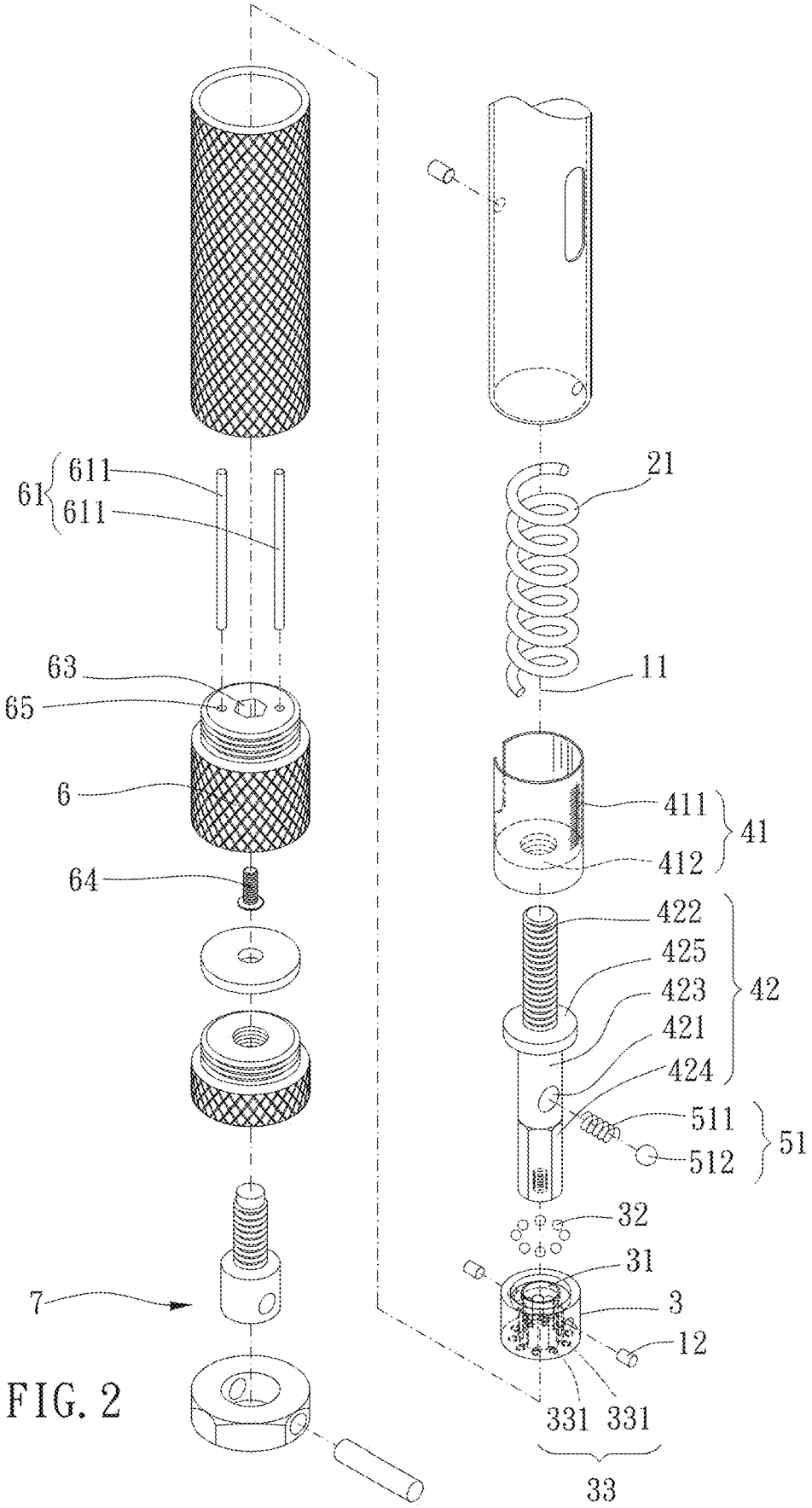
FIG. 2 is a breakdown view of the preferred embodiment of the present invention.
Figure 3:
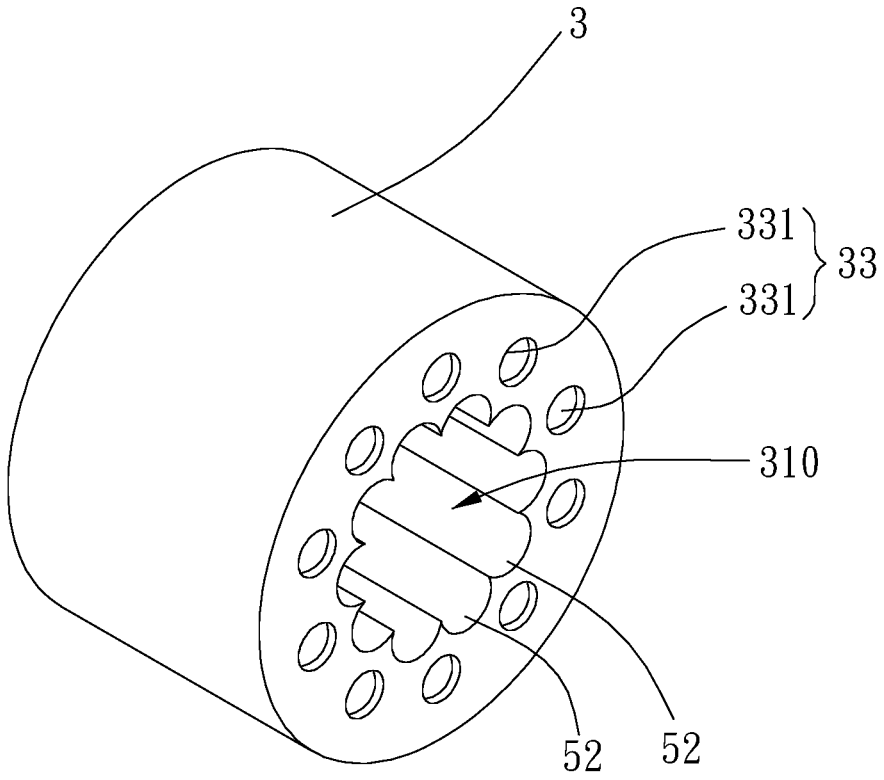
FIG. 3 is a partial stereogram of the preferred embodiment of the present invention.
Figure 4:
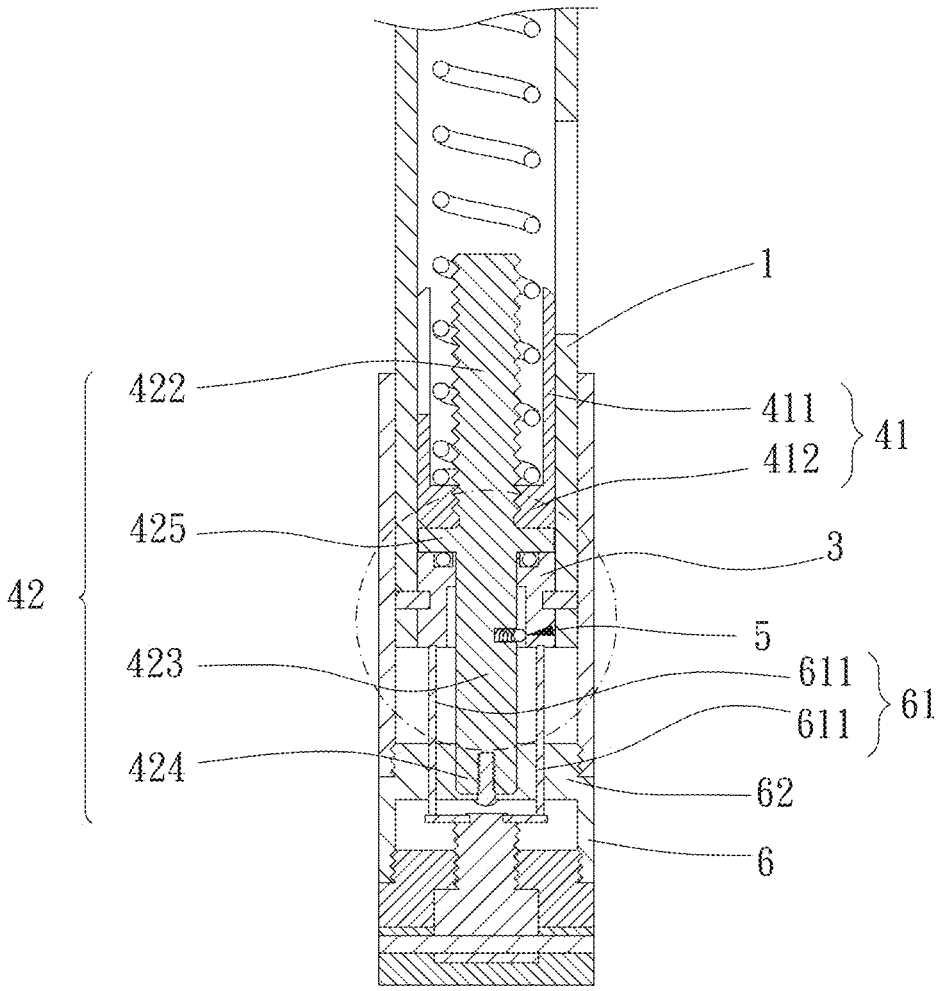
FIG. 4 is a partial cross-sectional side view of the preferred embodiment of the present invention.
Figure 5:
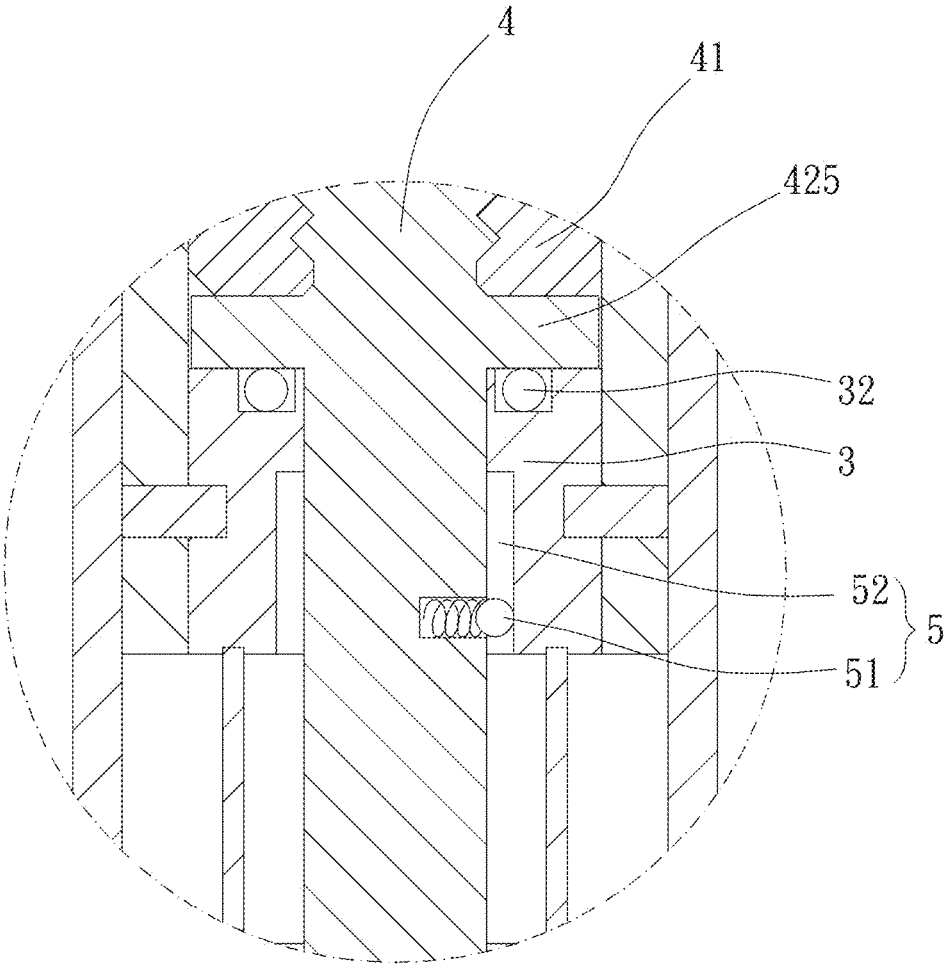
FIGS. 5 and 6 are drawings showing a partially-enlarged view of FIG. 4.
Figure 6:
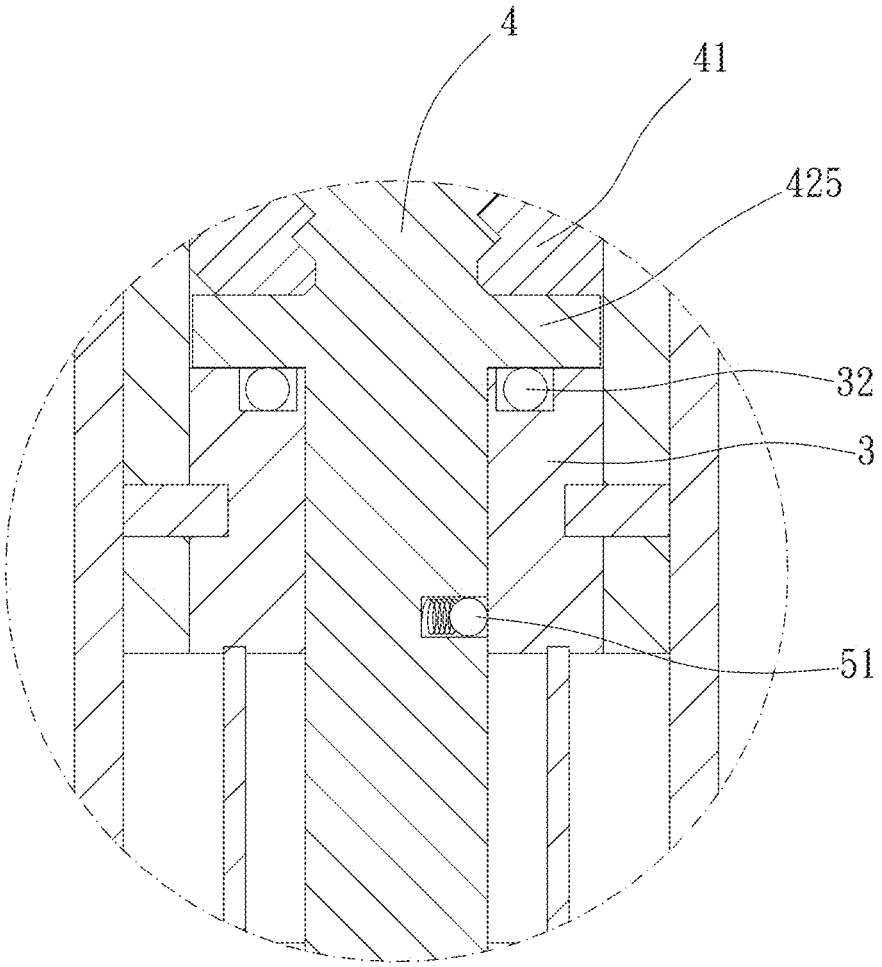
Figure 7:
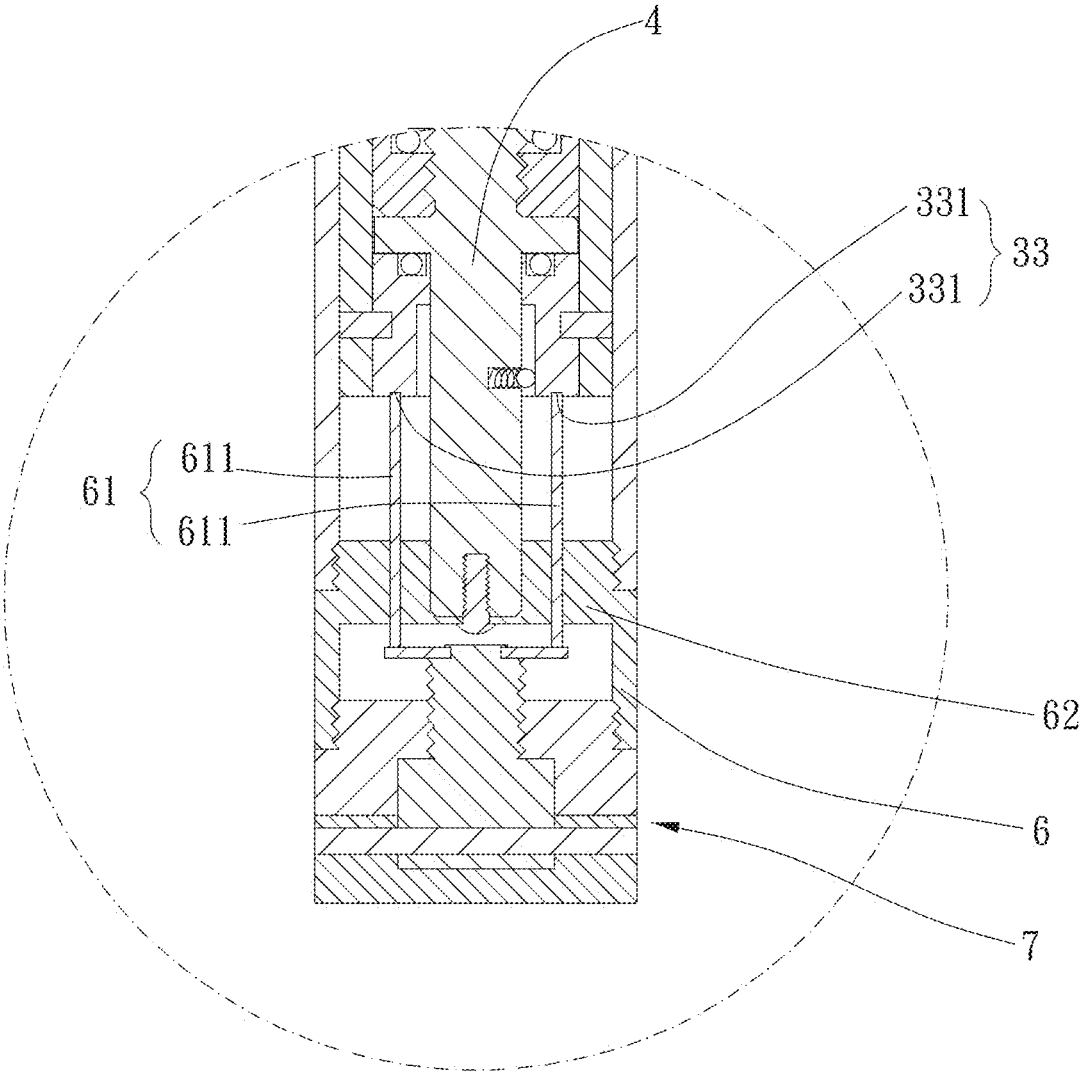
FIGS. 7 and 8 are drawings showing another partially-enlarged view of FIG. 4.
Figure 8:
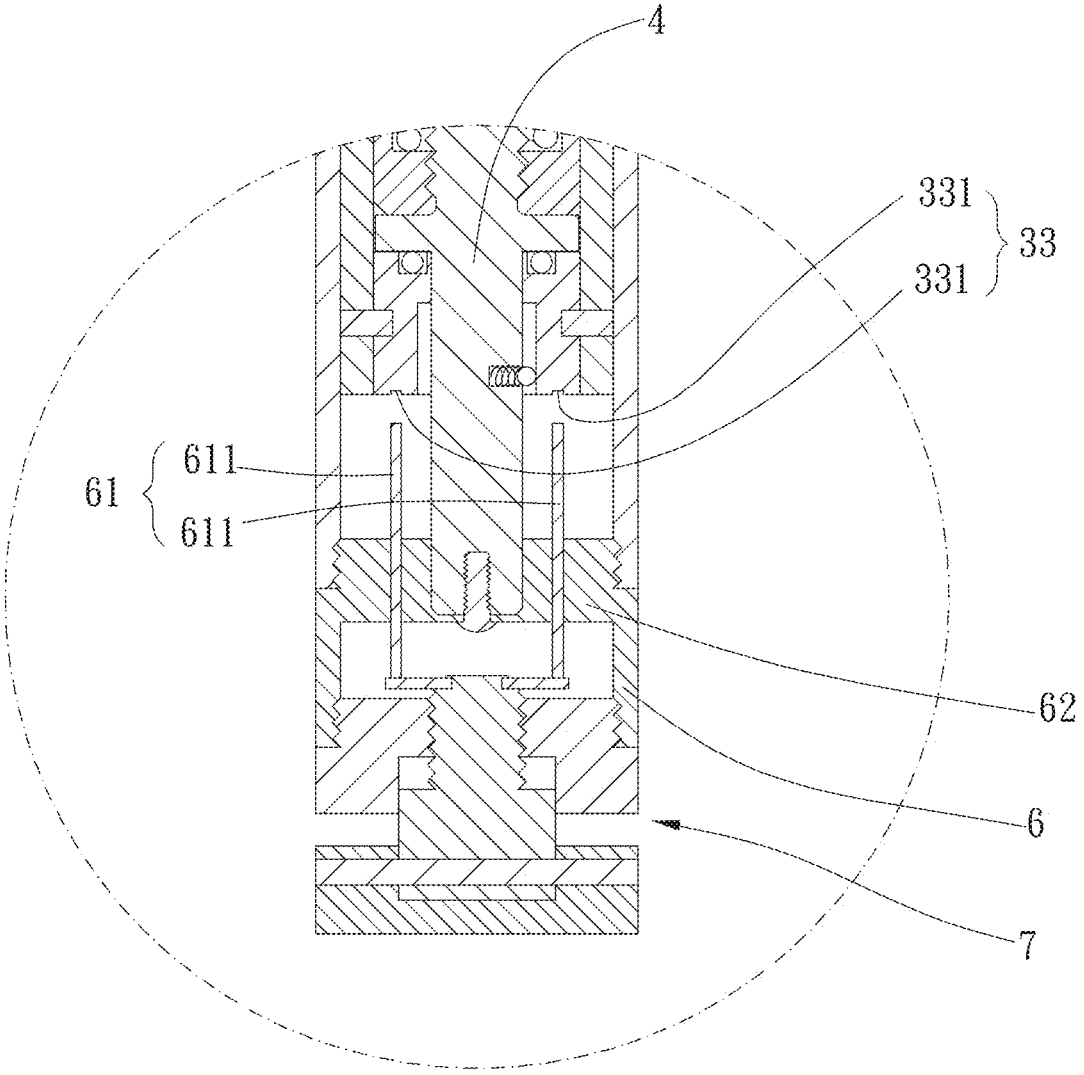

Please refer to FIGS. 1 to 8 for a preferred embodiment of a torque wrench which includes a main body 1, a driving portion 2, a positioning member 3, a torque adjusting assembly 4 and a tripping assembly 5.

The main body 1 defines an axial direction 11.

The driving portion 2 is disposed on an end of the main body 1, and when the driving portion 2 receives a torque which is greater than a torque setting value, the driving portion 2 is idling.

The positioning member 3 is fixedly disposed in the main body 1.

The torque adjusting assembly 4 includes an abutting member 41 and a mandrel 42, the abutting member 41 is movable along the axial direction 11 to adjust the torque setting value, the mandrel 42 is disposed in the main body 1, rotatable about the axial direction 11 and screwed to the abutting member 41, and the mandrel 42 is disposed through the positioning member 3 and rotatable about the axial direction 11. Through rotating the mandrel 42, the mandrel 42 can drive the abutting member 41 to slide along the axial direction ill so as to adjust the torque setting value.

The tripping assembly 5 includes an elastic abutting member 51 and a plurality of notches 52 arranged circumferentially, one of the elastic abutting member 51 and the plurality of notches 52 is disposed on the mandrel 42, the other of the elastic abutting member 51 and the plurality of notches 52 is disposed on the positioning member 3, the elastic abutting member 51 is abutted against one of the plurality of notches 52 normally, and when the mandrel 42 rotates relative to the positioning member 3, the elastic abutting member 51 trips among the plurality of notches. Therefore, when the mandrel 42 is rotated to adjust the torque setting value, for every certain rotating range, the elastic abutting member 51 trips from one said notch 52 to another notch 52 next to it and produces a sound effect and a vibration effect. The sound effect and the vibration effect can remind a user of a rotating range of the rotating member 6 to prevent over-rotating.

Specifically, the elastic abutting member 51 includes a first elastic member 511 and a restricting member 512, the mandrel 42 has a receiving hole 421 thereon, the restricting member 512 is non-detachably slidable within the receiving hole 421, and the first elastic member 511 is abutted against and between a bottom of the receiving hole 421 and the restricting member 512. Preferably, the restricting member 512 is a restricting ball which can smoothly trip from the plurality of notches 52. In other embodiment, the elastic abutting member 51 and the receiving hole 421 are disposed on the positioning member 3, and the plurality of notches 52 may be disposed on an outer circumferential wall of the mandrel 42.

More specifically, the positioning member 3 has a through hole 31 disposed therethrough in the axial direction 11, one of the elastic abutting member 51 and the plurality of notches 52 is disposed on a circumferential wall 310 of the through hole 31, and a pin 12 is disposed radially through the main body 1 to be inserted into the positioning member 3 to fix the positioning member 3 on the main body 1.

Preferably, the plurality of notches 52 are recessed on the circumferential wall 310 of the through hole 31, the plurality of notches 52 extend along the axial direction 11 from an end of the through hole 31 remote from the abutting member 41 for the plurality of notches 52 to be processed conveniently, and each said notch 52 is arc-shaped to allow the restricting member 512 to trip smoothly.

The mandrel 42 includes a threaded section 422 and a cylindrical shaft section 423, one of the elastic abutting member 51 and the plurality of notches 52 is disposed on the cylindrical shaft section 423, in this embodiment, the receiving hole 421 is disposed on the cylindrical shaft section 423, the mandrel 42 has a flange 425 between the cylindrical shaft section 423 and the threaded section 422, and the flange 425 is axially blocked between the positioning member 3 and the abutting member 4 to prevent the mandrel 42 from being detached from the positioning member 3.

Preferably, a plurality of balls 32 is disposed on an end face of the positioning member 3 facing the flange 425, and the balls 32 are abutted against the flange 425 to reduce a friction of the mandrel 42 and the positioning member 3 rotating relative to each other and further to prevent the end face of the positioning member 3 from being abraded.

It is to be noted that the torque wrench further has a rotating member 6, the rotating member 6 is non-rotatably sleeved on an end of the mandrel 42 remote from the abutting member 41 and rotatable relative to the main body 1, the positioning member 3 is between the abutting member 41 and the rotating member 6, an end face of the positioning member 3 on the axial direction 11 and remote from the abutting member 41 has a first abutting portion 33, the rotating member 6 has a second abutting portion 61 on the axial direction 11, the second abutting portion 61 is slidable between a first position and a second position, the rotating member 6 further has an adjusting member 7 on the axial direction 11, the second abutting portion 61 is between the adjusting member 7 and the positioning member 3, when the second abutting portion 61 is on the first position, the first abutting portion 33 is non-abuttable against the second abutting portion 61, and the rotating member 6 is rotatable relative to the main body 1 to drive the mandrel 42 to rotate. Through screwing the adjusting member 7, the second abutting portion 61 is pushed to be in the second position, and the second abutting portion 61 is abuttable against the first abutting portion 33, and the rotating member 6 and the mandrel 42 is non-rotatable relative to the main body 1 so as to lock the torque setting value. The torque setting value is locked or adjusted by rotating the adjusting member 7, so the second abutting portion 61 can be prevented from moving to the second position.

Preferably the mandrel 42 further has a non-cylindrical section 424, the cylindrical shaft section 423 is between the threaded section 422 and the non-cylindrical section 424, the rotating member 6 includes a bottom wall 62, the bottom wall 62 has a non-cylindrical hole 63 on the axial direction 11 and corresponding to the non-cylindrical section 424, the non-cylindrical hole 63 is sleeved on the non-cylindrical section 424 to drive the mandrel 42 to rotate, and a fixing member 64 is fixed on the bottom wall 62 and an end of the non-cylindrical section 424 remote from the threaded section 422 on the axial direction 11 to prevent the rotating member 6 from sliding along the axial direction 11 and being detached from the mandrel 42.

Specifically, the bottom wall 62 has at least one pin hole 65 on the axial direction 11, the second abutting portion 61 includes at least one inserting pin 611, in this embodiment, there are two said pin holes 65 and two said inserting pins 611, each said inserting pin 611 is slidably disposed through one said pin hole 65, the first abutting portion 33 includes a plurality of recessed holes 331 which are circumferentially and spacingly arranged, the plurality of recessed holes 331 are disposed on the end face of the positioning member 3 on the axial direction 11 and remote from the abutting member 41, and when the at least one inserting pin 611 moves to the second position, each said inserting pin 611 is inserted into one of the plurality of recessed holes 331 to prevent the rotating member 6 and the mandrel 42 from rotating relative to the main body 1.

In addition, the driving portion 2 includes a second elastic member 21, the abutting member 41 is abutted against the second elastic member 21, and the torque setting value varies according to a compression of the second elastic member 21 abutted by the abutting member 4. The abutting member 41 includes an annular wall 411 and a blocking wall 412, the threaded section 422 is screwed with the blocking wall 412, the flange 425 is between the blocking wall 412 and the positioning member 3, and the blocking wall 412 is abutted against the second elastic member 21 and located in the annular wall 411 to reduce a volume of the abutting member 41 taken in the main body 1 on the axial direction 11 and to shorten an overall length of the main body 1.

Given the above, when the mandrel is rotated to adjust the torque setting value, for every certain rotating range, the elastic abutting member trips from one said notch to another notch next to it and produces a sound effect and a vibration effect. The sound effect and the vibration effect can remind a user of a rotating range of the rotating member to prevent over-rotating.

While we have shown and described various embodiments in accordance with the present invention, it should be clear to those skilled in the art that further embodiments may be made without departing from the scope of the present invention.

What is claimed is:

1. A torque wrench, including:

a main body, defining an axial direction;

a driving portion, disposed on an end of the main body, when the driving portion receives a torque which is greater than a torque setting value, the driving portion is idling;

a positioning member, fixedly disposed in the main body;

a torque adjusting assembly, including an abutting member and a mandrel, the abutting member being movable along the axial direction to adjust the torque setting value, the mandrel being disposed in the main body, rotatable about the axial direction and screwed to the abutting member, the mandrel being disposed through the positioning member and rotatable about the axial direction;

a tripping assembly, including an elastic abutting member and a plurality of notches arranged circumferentially, the elastic abutting member being disposed on the mandrel, the plurality of notches being disposed on the positioning member, the elastic abutting member being abutted against one of the plurality of notches normally, when the mandrel rotates relative to the positioning member, the elastic abutting member trips among the plurality of notches;

wherein the mandrel includes a threaded section and a cylindrical shaft section, the elastic abutting member is disposed on the cylindrical shaft section, the mandrel has a flange between the cylindrical shaft section and the threaded section, and the flange is axially blocked between the positioning member and the abutting member.

2. The torque wrench of claim 1, wherein the elastic abutting member includes a first elastic member and a restricting member, the mandrel has a receiving hole thereon, the restricting member is non-detachably slidable within the receiving hole, and the first elastic member is abutted against and between a bottom of the receiving hole and the restricting member.

3. The torque wrench of claim 1, wherein the positioning member has a through hole disposed therethrough in the axial direction, the plurality of notches are disposed on a circumferential wall of the through hole, and a pin is disposed radially through the main body to be inserted into the positioning member.

4. The torque wrench of claim 3, wherein the plurality of notches are recessed on the circumferential wall of the through hole, the plurality of notches extend along the axial direction from an end of the through hole remote from the abutting member, and each said notch is arc-shaped.

5. The torque wrench of claim 1, wherein a plurality of balls is disposed on an end face of the positioning member facing the flange, and the balls are abutted against the flange.

6. The torque wrench of claim 1, further including a rotating member, the rotating member being non-rotatably sleeved on an end of the mandrel remote from the abutting member and rotatable relative to the main body, the positioning member being between the abutting member and the rotating member, an end face of the positioning member on the axial direction and remote from the abutting member having a first abutting portion, the rotating member having a second abutting portion on the axial direction, the second abutting portion being slidable between a first position and a second position, the rotating member further having an adjusting member on the axial direction, the second abutting portion being between the adjusting member and the positioning member, wherein when the second abutting portion is on the first position, the first abutting portion is non-abuttable against the second abutting portion, through screwing the adjusting member, the second abutting portion is pushed to be in the second position, and the second abutting portion is abuttable against the first abutting portion.

7. The torque wrench of claim 6, wherein the mandrel further has a non-cylindrical section, the cylindrical shaft section is between the threaded section and the non-cylindrical section, the rotating member includes a bottom wall, the bottom wall has a non-cylindrical hole on the axial direction and corresponding to the non-cylindrical section, the non-cylindrical hole is sleeved on the non-cylindrical section, and a fixing member is fixed on the bottom wall and an end of the non-cylindrical section remote from the threaded section on the axial direction.

8. The torque wrench of claim 7, wherein the bottom wall has at least one pin hole on the axial direction, the second abutting portion includes at least one inserting pin, each said inserting pin is slidably disposed through one said pin hole, the first abutting portion includes a plurality of recessed holes which are circumferentially and spacingly arranged, the plurality of recessed holes are disposed on the end face of the positioning member on the axial direction and remote from the abutting member, and when the at least one inserting pin moves to the second position, each said inserting pin is inserted into one of the plurality of recessed holes.

9. The torque wrench of claim 4, wherein the elastic abutting member includes a first elastic member and a restricting member, the mandrel has a receiving hole thereon, the restricting member is non-detachably slidable within the receiving hole, and the first elastic member is respectively abutted against and between a bottom of the receiving hole and the restricting hole; a plurality of balls is disposed on an end face of the positioning member facing the flange, and the balls are abutted against the flange; the torque wrench further includes a rotating member, the rotating member is non-rotatably sleeved on an end of the mandrel remote from the abutting member and rotatable relative to the main body, the positioning member is between the abutting member and the rotating member, the end face of the positioning member on the axial direction and remote from the abutting member has a first abutting portion, the rotating member has a second abutting portion on the axial direction, the second abutting portion is slidable between a first position and a second position, the rotating member further has an adjusting member on the axial direction, the second abutting portion is between the adjusting member and the positioning member, when the second abutting portion is on the first position, the first abutting portion is non-abuttable against the second abutting portion, through screwing the adjusting member, the second abutting portion is pushed to be in the second position, and the second abutting portion is abuttable against the first abutting portion; the mandrel further has a non-cylindrical section, the cylindrical shaft section is between the threaded section and the non-cylindrical section, the rotating member includes a bottom wall, the bottom wall has a non-cylindrical hole on the axial direction and corresponding to the non-cylindrical section, the non-cylindrical hole is sleeved on the non-cylindrical section, and a fixing member is fixed on the bottom wall and an end of the non-cylindrical section remote from the threaded section on the axial direction; the bottom wall has at least one pin hole on the axial direction, the second abutting portion includes at least one inserting pin, each said inserting pin is slidably disposed through one said pin hole, the first abutting portion includes a plurality of recessed holes which are circumferentially and spacingly arranged, the plurality of recessed holes are disposed on the end face of the positioning member on the axial direction and remote from the abutting member, and when the at least one inserting pin moves to the second position, each said inserting pin is inserted into one of the plurality of recessed holes; the restricting member is a restricting ball; the driving portion includes a second elastic member, and the abutting member is abutted against the second elastic member; the abutting member includes an annular wall and a blocking wall, the threaded section is screwed with the blocking wall, the flange is between the blocking wall and the positioning member, and the blocking wall is abutted against the second elastic member and located in the annular wall.

* * * * *